US008354792B2

(12) United States Patent
Nagamachi et al.

(10) Patent No.: US 8,354,792 B2
(45) Date of Patent: Jan. 15, 2013

(54) FUSED JOINT STRUCTURE IN A LAMP TUBE AND FORMING METHOD THEREFOR

(75) Inventors: Nobuhiro Nagamachi, Hyogo (JP); Toyohiko Kumada, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 436 days.

(21) Appl. No.: 12/292,175

(22) Filed: Nov. 13, 2008

(65) Prior Publication Data

US 2009/0121635 A1 May 14, 2009

(30) Foreign Application Priority Data

Nov. 14, 2007 (JP) ..... 2007-295034

(51) Int. Cl.
*H01J 17/04* (2006.01)

(52) U.S. Cl. ..... 313/631

(58) Field of Classification Search ..... 313/627–643, 313/567

See application file for complete search history.

(56) References Cited

U.S. PATENT DOCUMENTS

| | | | | |
|---|---|---|---|---|
| 3,848,151 | A * | 11/1974 | McVey | 313/601 |
| 4,703,221 | A * | 10/1987 | Ochoa et al. | 313/332 |
| 5,304,892 | A * | 4/1994 | Lewandowski et al. | 313/623 |
| 6,354,900 | B1 * | 3/2002 | Ohshima et al. | 445/26 |
| 6,903,509 | B2 | 6/2005 | Kanzaki | |
| 7,169,002 | B2 | 1/2007 | Mizobe | |
| 2003/0232564 | A1 * | 12/2003 | Mochizuki et al. | 445/26 |
| 2005/0003729 | A1 * | 1/2005 | Mizobe | 445/22 |

FOREIGN PATENT DOCUMENTS

| | | | |
|---|---|---|---|
| JP | 2000-067785 | A | 3/2000 |
| JP | 2003-257373 | A | 9/2003 |
| JP | 2003-331779 | A | 11/2003 |
| JP | 2004-363014 | A | 12/2004 |
| JP | 2007-501493 | A | 1/2007 |

* cited by examiner

*Primary Examiner* — Anh Mai
*Assistant Examiner* — Zachary J Snyder
(74) *Attorney, Agent, or Firm* — Rader, Fishman & Grauer PLLC

(57) ABSTRACT

A fused joint structure comprises a metallic foil; and a conductive member made of high melting point metal, wherein a concave portion is formed in the metallic foil and the conductive member on an area where the metallic foil is put together on a surface of the conductive member, and wherein a circumferential edge of the concave portion is covered with the conductive member.

7 Claims, 9 Drawing Sheets

FIG. 9

Mo-W welding

| Resistance welding Average comparison (%) | Resistance welding | Conventional Laser Welding | Embodiment |
|---|---|---|---|
| 190 | | | |
| 180 | | | |
| 170 | | | |
| 160 | | | |
| 150 | | | |
| 140 | × | × | ×× |
| 130 | × | | ××××× |
| 120 | × | | ××× |
| 110 | ××× | | |
| 100 | × | | |
| 90 | × | | |
| 80 | | × | |
| 70 | × | ×× | |
| 60 | × | ×× | |
| 50 | | × | |
| 40 | | × | |
| 30 | | | |
| 20 | | | |
| 10 | | ×× | |
| 0 | | | |

Mo-Mo welding

| Resistance welding Average comparison (%) | Resistance welding | Conventional Laser Welding | Embodiment |
|---|---|---|---|
| 190 | | | |
| 180 | | | |
| 170 | | | |
| 160 | | | |
| 150 | | | |
| 140 | | | |
| 130 | × | | ××× |
| 120 | ×× | | ××××× |
| 110 | ×× | | ×× |
| 100 | ××× | × | |
| 90 | × | | |
| 80 | | | |
| 70 | | × | |
| 60 | | ×× | |
| 50 | × | ×× | |
| 40 | | ××× | |
| 30 | | | |
| 20 | | | |
| 10 | | × | |
| 0 | | | |

FUSED JOINT STRUCTURE IN A LAMP TUBE AND FORMING METHOD THEREFOR

CROSS-REFERENCES TO RELATED APPLICATION

This application claims priority from Japanese Patent Application Serial No. 2007-295034 filed Nov. 14, 2008, the contents of which are incorporated herein by reference in its entirety.

TECHNICAL FIELD

Described herein are a fused joint structure in an electric supply structure of a lamp tube, and a forming method thereof.

BACKGROUND

Conventionally, in a halogen lamp for business machine, a mercury lamp for a liquid crystal projector light source, or a metal halide lamp for general lighting, etc., an internal lead and an external lead are joined together through a metallic foil in a sealing portion, so as to secure airtightness of a light emission space in the lamp tube. When such internal and external leads were conventionally joined to the metallic foil, for example, a joint portion of the metallic foil and the internal lead of the halogen lamp for business machine, which is currently sealed by pinch sealing, or a joint portion of the metallic foil and the internal lead of a mercury lamp for a projector light source, which is currently sealed by shrink-sealing, was joined by a resistor welding.

However, in such a resistor welding process, the welding conditions change due to changes of a welding electrode rod with passage of time, so that the welding quality is not stabilized, whereby there is a problem of peeling due to insufficient adhesive strength or a problem of generation of holes in the metallic foil at time of the welding. Furthermore, in the resistance welding process, application of pressure is necessary at the time of welding in order to obtain the welding strength, so that there is a possibility that deformation and creasing of detailed parts, such as the electrode or the lead rod may occur by the pressurization.

Japanese Laid Open Patent No. 2004-363014 teaches a tungsten electrode and a molybdenum foil are joined by a laser welding using a YAG laser in manufacture of a high-pressure discharge lamp, instead of the resistance welding. Also, refer to Japanese Laid Open Patent No. 2003-257373.

SUMMARY

However, when the inventors actually welded a lead rod and a metallic foil of the lamp electrode by a YAG laser, as shown in FIG. 10, in a tungsten electrode and the metallic foil such as a molybdenum foil, used for the lamp, a welded nugget portion is recrystallized by the energy of the YAG laser welding, so that the gain boundary of a recrystallization portion and a non-recrystallization portion tends to fracture due to heat contraction after welding portion. It turned out that the welded became very weak in many cases, and there was a problem of peeling of welding.

In view of the above problems of the prior art, it is an object of the present invention to propose a fused joint structure in a lamp tube and a forming method therefore, in which it is possible to acquire the stable and high strength of welding and it is possible to realize reduction of deformation, insufficient welding strength, and a problem of generation of holes due to the welding.

In view of the above problems, the present fused joint structure comprises a metallic foil, a conductive member made of high melting point metal, wherein a concave portion is formed in the metallic foil and the conductive member on an area where the metallic foil is put on a surface of the conductive member, and wherein a circumferential edge of the concave portion is covered with the conductive member.

In another aspect thereof, the conductive member may be made of tungsten or molybdenum, and the metallic foil may be made of molybdenum.

In still another aspect thereof, the fused joint structure is formed in a method in which laser light whose energy is 40 $MW/cm^2$ or more, is irradiated on the area where the metallic foil is put on a surface of the conductive member, so as to joint the conductive member and the metallic foil.

In the fused joint structure in the lamp tube according to the present invention, it is possible to acquire the stable and high strength of welding (portion) and it is possible to realize reduction of deformation, insufficient welding strength, and generation of holes due to the welding. Furthermore, in the forming method of the fused joint structure in the lamp tube according to the present invention, it is possible to offer a fused joint structure having a stable and high welding strength.

BRIEF DESCRIPTION OF DRAWINGS

Other features and advantages of the present fused joint structure in a lamp tube, and the present forming method therefor will be apparent from the ensuing description, taken in conjunction with the accompanying drawings, in which:

FIG. 9 shows a result of an experiment of the welding strength; and

DETAILED DESCRIPTION

A description will now be given, referring to embodiments of the present fused joint structure in a lamp tube, and the present manufacture method therefor. While the claims are not limited to such embodiments, an appreciation of various aspects of the present flash lamp emitting device is best gained through a discussion of various examples thereof.

A lamp tube in which a fused joint structure according to the present invention is provided is, for example, a halogen lamp such as an incandescence lamp and a discharge lamp. In addition, in the present invention, a "conductive member" will refer to an internal lead rod and an external lead rod in case of a halogen lamp. In case of a discharge lamp using one metallic foil sealing, it refers to an electrode rod and an external lead rod. In case of a discharge lamp using two or more metallic foil sealing, and it refers to a disk-like member connected to an electrode rod to which two or more metallic foils are welded and a disk-like member connected to an external lead.

Figure 1:
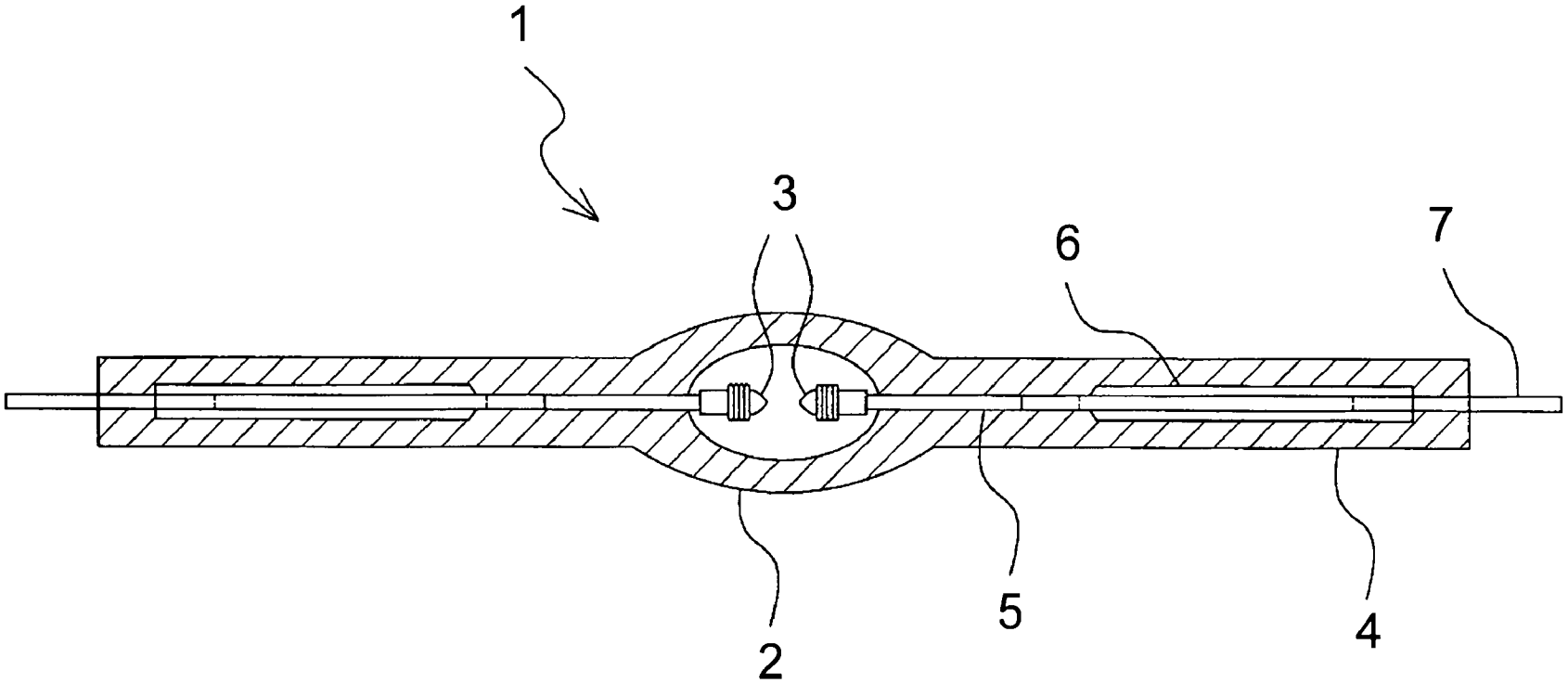
FIG. 1 is a cross sectional view of the structure of a both end sealing type discharge lamp which uses one sheet metallic foil sealing according to a first embodiment.

A first embodiment according to the present invention will be described referring to FIGS. 1 to 4. FIG. 1 is a cross sectional view of the structure of a both end sealing type discharge lamp which uses one sheet metallic foil sealing. As shown in this figure, in an electric discharge container 2 of the discharge lamp 1, a pair of electrodes 3 which face each other is arranged. A metallic foil 6 to which an electrode rod 5 which is made of a high temperature melting point metal and which is connected to one of the electrodes 3 is connected is airtightly sealed in a sealing portion 4 which is continuously formed from the electric discharge container 2. Furthermore, an external lead 7 is joined to the metallic foil 6. Here, as taught in Japanese Laid Open Patent No. 2003-257373, in the sealing portion of the high-pressure mercury lamp, a welding portion of the metallic foil 6 with the electrode is made small, and a flat square modified metallic foil is shaped so as to form the metallic foil, to be winded around the outer surface of the electrode, in which a sectional view of wide portions other than the narrow portion is in a Ω character shape or approximately a "W" character shape.

Figure 2:
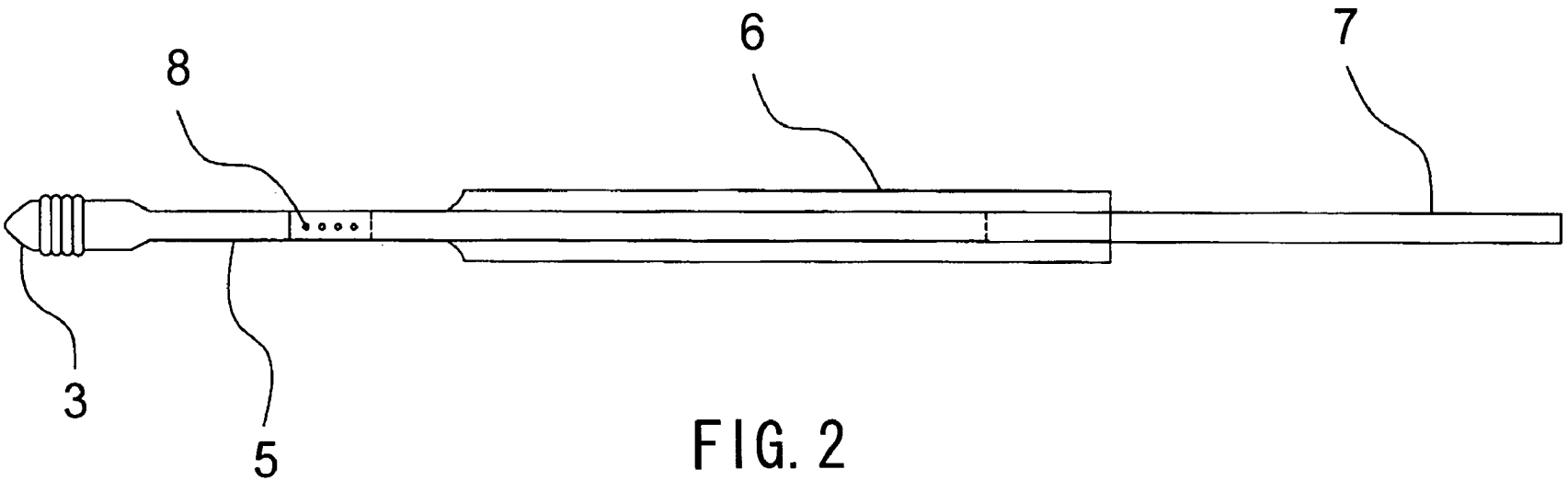
FIG. 2 is plan view showing an entire fused joint structure in a sealing portion of a discharge lamp shown in FIG. 1.
Figure 3:
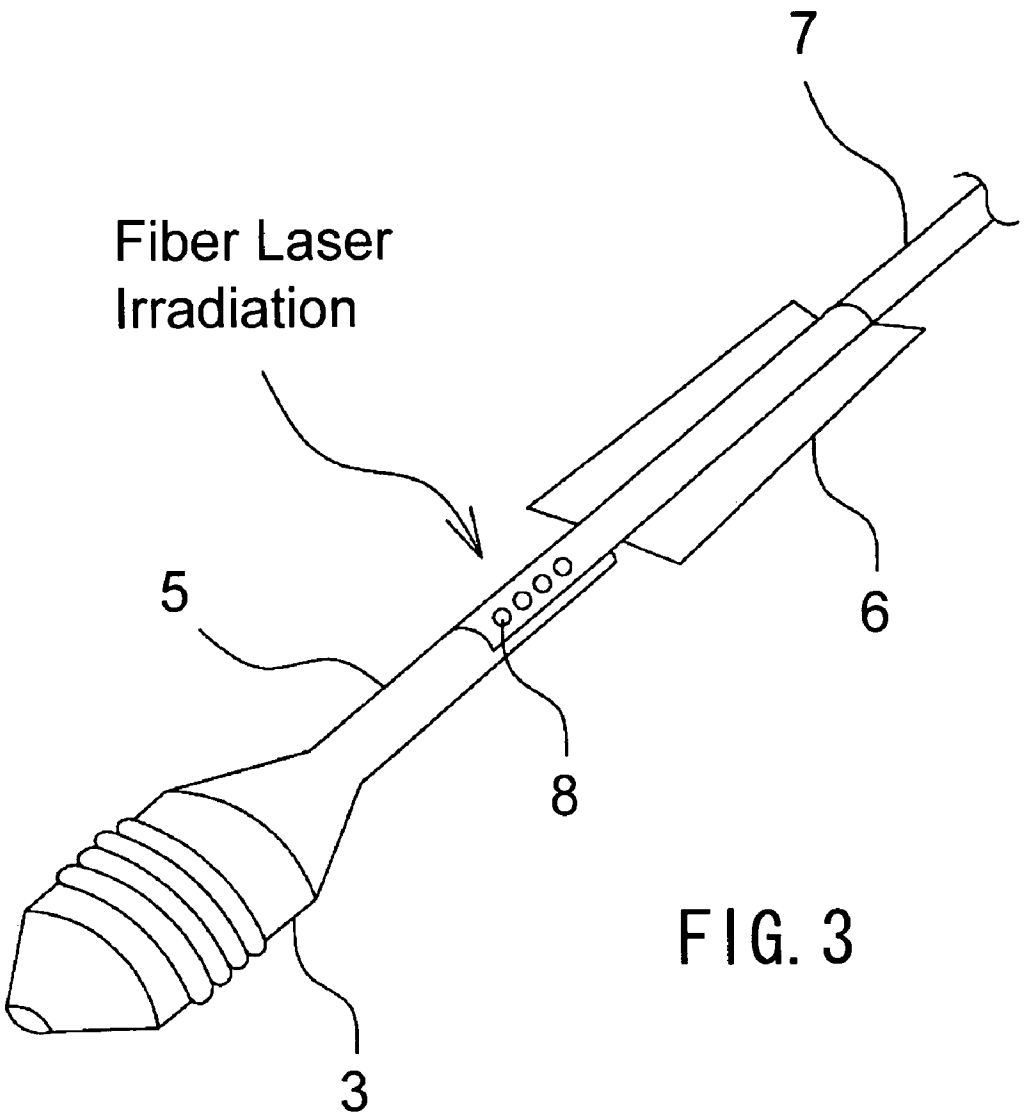
FIG. 3 is a perspective view of an entire fused joint structure in a sealing portion of a discharge lamp shown in FIG. 1.

FIG. 2 is a plan view of a fused joint structure in the sealing portion of the discharge lamp shown in FIG. 1. FIG. 3 is a perspective view thereof. As shown in these figures, a fiber laser is irradiated, for melting on an area where the metallic foil 6 is put on the surface of the electrode rod 5 which is a conductive member made of a high melting point metal, so as to join the electrode rod 5 and the metallic foil 6. The welded portion 8 is a part where the fiber laser is irradiated so that the electrode rod 5 and the metallic foil 6 are joined. In addition, in this example, a tungsten rod is used as the electrode rod 5, and a molybdenum foil is used as the metallic foil 6.

Figure 4:
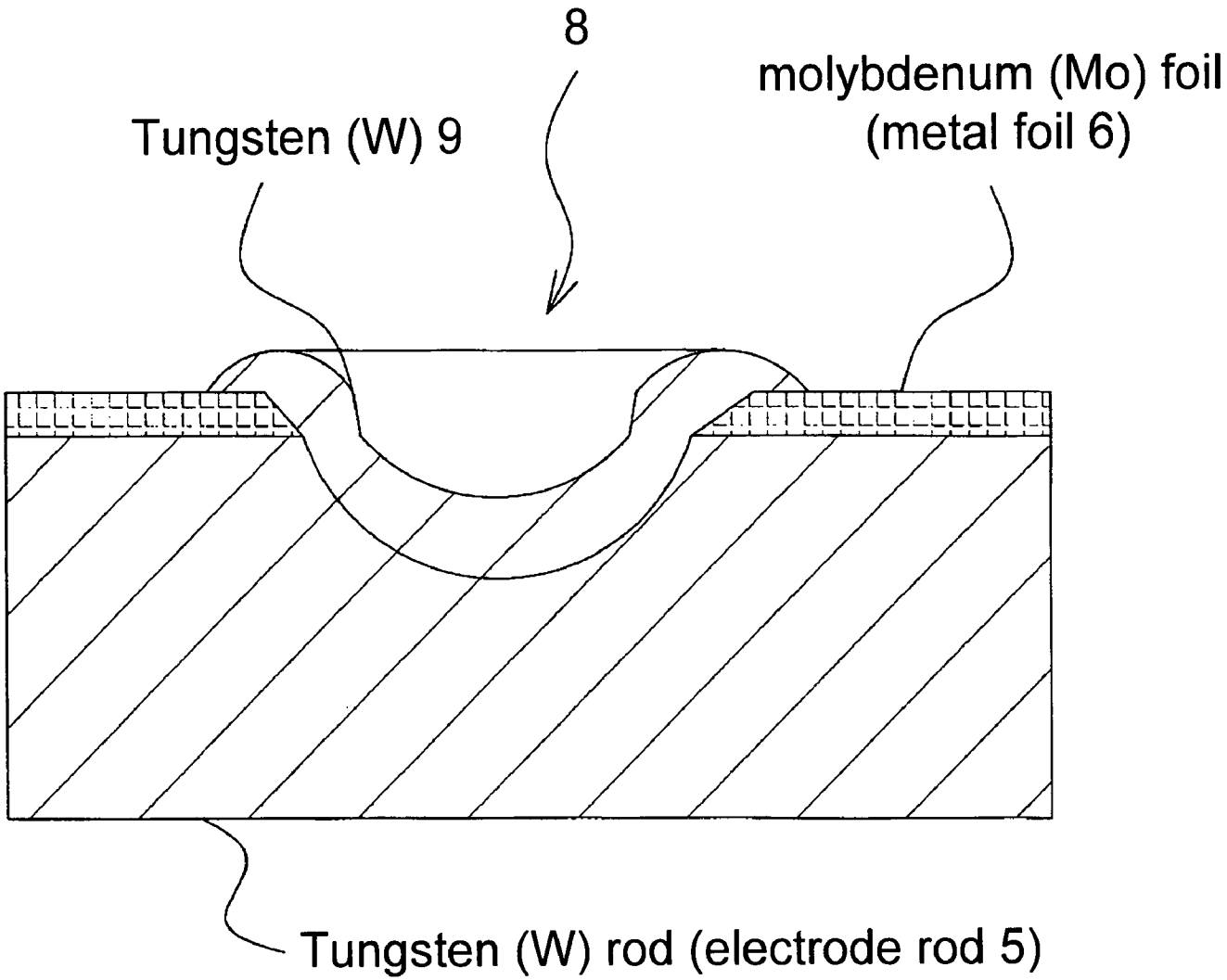
FIG. 4 is an enlarged sectional view of the welded portion 8 shown in FIG. 3.

FIG. 4 is an enlarged sectional view of the welded portion 8 shown in FIG. 3. When the fiber laser is irradiated, as shown in this figure, the electrode rod 5 made of a tungsten rod and the metallic foil 6 made of a molybdenum foil are melted together, so that the tungsten rod 5 which is the melted tungsten 9, is formed as a thickness portion on the circumference edge of an opening formed in the surface of the molybdenum foil 6 and the tungsten rod 5. Thus, since the tungsten rod 5 and the tungsten 9 formed on the surface of the circumferential edge of the opening of the molybdenum foil 6 are combined so as to be integrally joined, the tungsten rod 5 and the molybdenum foil 6 are joined firmly. In addition, combinations of a typical conductive member and metallic foil material, are tungsten (W) and molybdenum (Mo), and molybdenum (Mo) and molybdenum (Mo). These combinations are also suitable for prevention of defective airtightness and foil fusing in the sealing portion subject to high temperature at time of lamp lighting.

Formation of the fused joint structure according to the embodiment is set forth below. The electrode rod 5, and the metallic foil 6 which is conductive member, are put one on top of another, and laser light from a fiber laser apparatus whose energy density is set to 40 MW/cm$^2$, is irradiated from a side of the metallic foil 6. Specifically, when the molybdenum (Mo) foil and the tungsten (W) rod are welded to each other, under conditions in which, in the fiber laser apparatus, the diameter of the laser light is reduced to about 20 μm (micrometers), the energy density is 40 MW/cm$^2$, for example, 60 MW/cm$^2$, and a laser output thereof is 200 W, the laser light is irradiated thereto at a distance of 100 mm from the side of the molybdenum (Mo) foil, for 2.5 msec. Here, the molybdenum (Mo) foil is shaped in a gutter like shape by bending the molybdenum foil with a 0.7 mm width, in accordance with the shape of the tungsten rod so as to have a 0.5 mm width and a 20 μm (micrometers) thickness. The diameter of tungsten (W) rod is 0.4 mm. As mentioned above, irradiated laser light penetrates the molybdenum (Mo) foil which is the upper material of the put-together materials, and the tungsten (W) which is the lower material is blown off so that some of the tungsten (W) which is blown off sublimates. However, the surface viscosity of some of the tungsten (W) which has been blown off, decreases, thereby flowing onto the molybdenum (Mo) foil around the blown off portion, whereby the molybdenum (Mo) foil is sandwiched in shape of the circumference edge between the tungsten (W) which flows onto the molybdenum and the tungsten (W) rod which is the lower material. Thus, in the welding structure, the tungsten (W) rod is blown off so that a concave portion is formed as shown in FIG. 4

Figure 5:
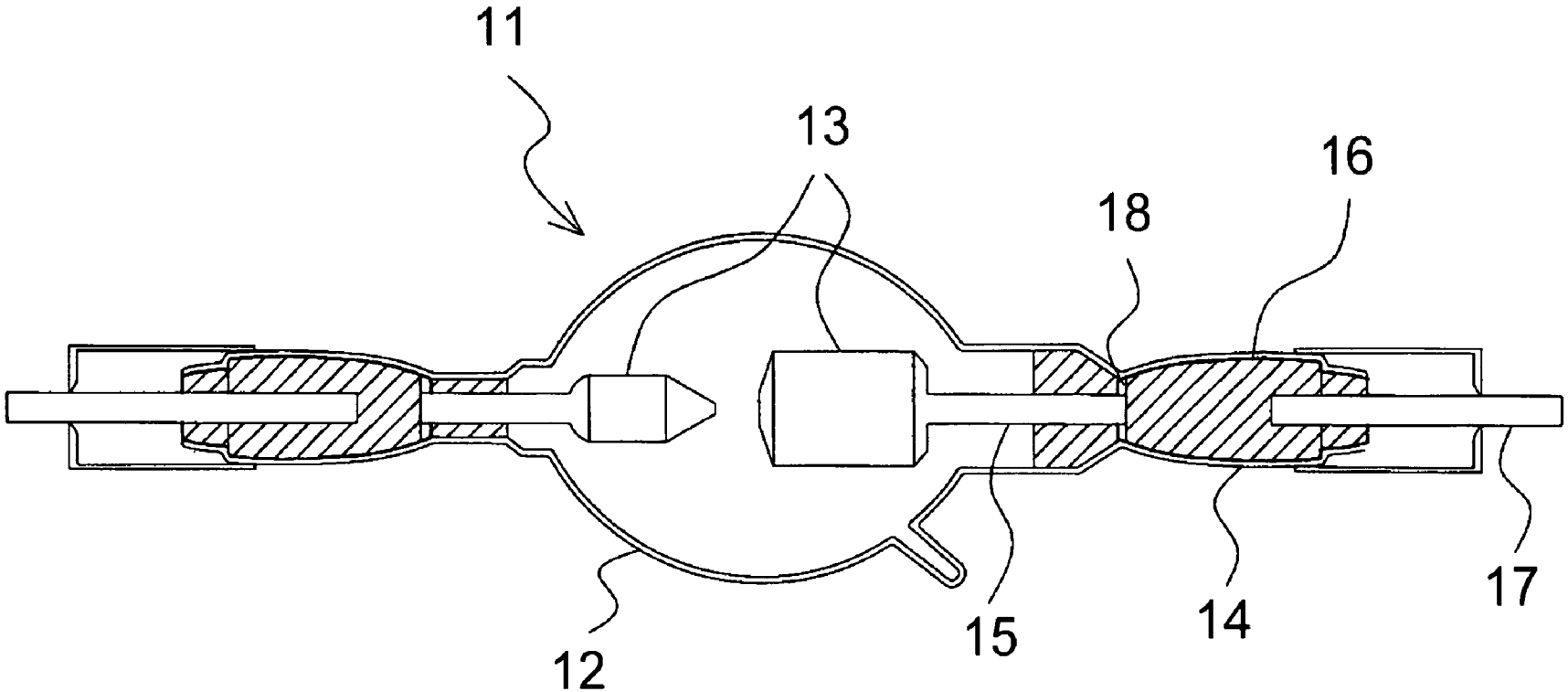
FIG. 5 is a cross sectional view of the structure of a both end sealing type discharge lamp in which sealing by two or more metallic foils is used.

A second embodiment according to the present invention will be described below referring to FIGS. 5 and 6. FIG. 5 is a cross sectional view of the structure of a both end sealing type discharge lamp in which sealing of two or more metallic foils is used. As shown in this figure, in an electric discharge container 12 of this discharge lamp 11, a pair of electrodes 13 is arranged facing each other. In each of the sealing portions 14 which is continuously formed from the electric discharge container 12, two or more metallic foils 16 connected to a metal disk 18 formed integrally with the electrode rod 15 which is connected to the electrode 13 and which is made of a high melting point metal, are airtightly sealed. Furthermore, an external lead 17 is joined with the metallic foil 16.

Figure 6A:
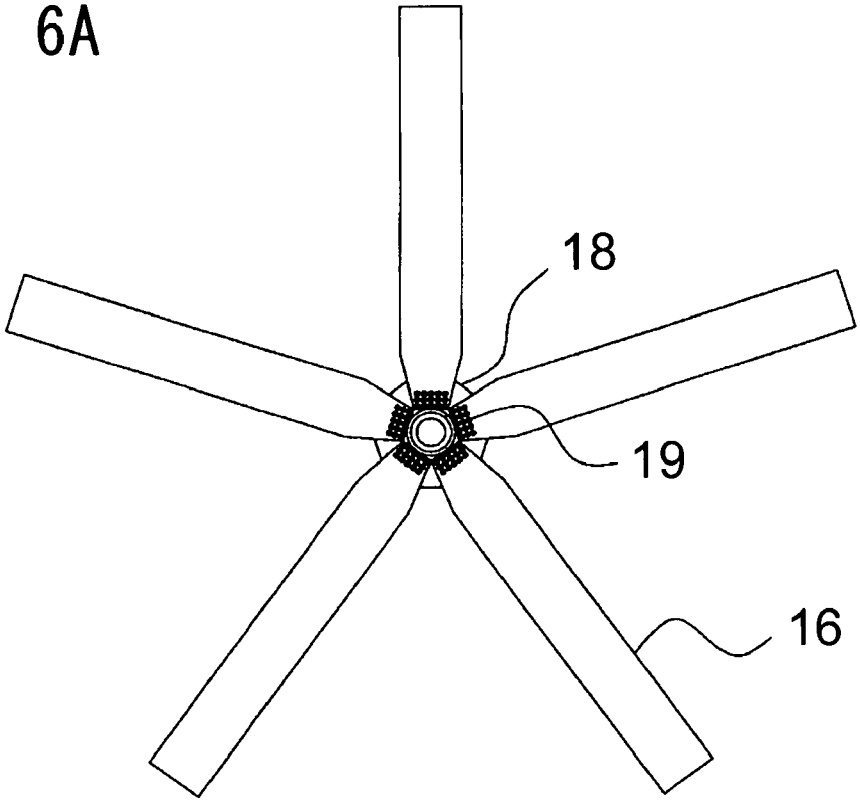
FIG. 6A is a plan view showing the entire structure of a fused joint structure at time of welding of the sealing portion of the discharge lamp shown in FIG. 5.
Figure 6B:
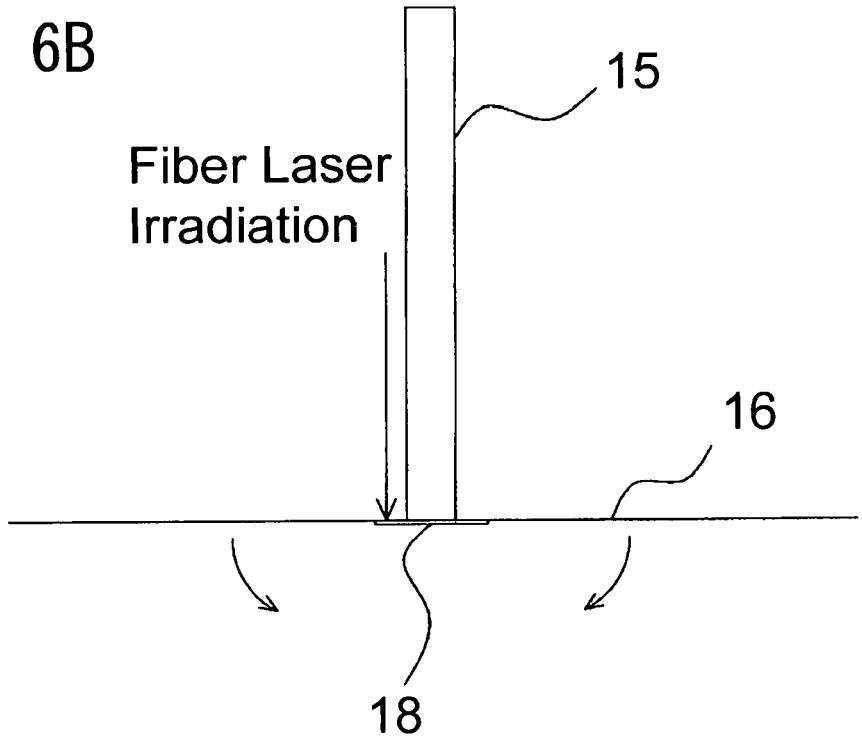
FIG. 6B is a side elevational view thereof.

FIG. 6A is a plan view of a fused joint structure at time of welding of the sealing portion of the discharge lamp shown in FIG. 5. FIG. 6B is a side elevational view thereof. As shown in FIG. 6B, fiber laser is irradiated on an area where a plurality of metallic foils 16 are put together on a surface of the metal disk 18 formed integrally with the electrode rod 5 as a conductive member which is made of a high melting point metal, whereby they are melted, so that the metal disk 18 and the metallic foils 16 are joined. The welded portion 19 is a portion where fiber laser is irradiated so that the metal disk 18 and metallic foil 16 are joined. In addition, the metallic foils 16 are bent in directions of arrows shown in FIG. 6B after welding, so that as shown in FIG. 5 they are arranged in the sealing portion 14. Here, an example in which a molybdenum disk is used as a metal disk 18, and a molybdenum foil is used as a metallic foil 6, is shown.

Next, the fused joint structure according to the embodiment is formed as set forth below. The metal disk 18 formed integrally with the electrode rod 15 as a conductive member, and the metallic foil 16 are put together, and laser light emitted from the metallic foil 16 side of a fiber laser apparatus in which the energy density is 40 MW/cm$^2$ is irradiated thereto. Specifically, when the molybdenum (Mo) foil and the molybdenum (Mo) disk are welded with each other, under condition where in the fiber laser apparatus, the diameter of the laser light is reduced to about 20 μm (micrometers), the energy density is 40 MW/cm$^2$ or more, for example, 60 MW/cm$^2$, and a laser output thereof is 200 W, the laser light whose output is 200 W is irradiated thereto at a distance of 100 mm from the side of the molybdenum (Mo) foil, for tens of microseconds, while the molybdenum (Mo) foil and the molybdenum (Mo) disc are brought into close contact with each other by a jig etc. The molybdenum (Mo) foil is 8-12 mm in width and 40 μm (micrometers) in thickness, the molybdenum (Mo) disk is 17 mm in diameter. The molybdenum (Mo) foil with 40 μm thickness which is the upper material, and the molybdenum (Mo) disc with the 17 mm diameter and 0.5 mm thickness are put together, and then when 200 W output fiber laser in which the diameter of a beam is narrowed down to 20 μm or less, is irradiated from above the molybdenum (Mo) foil, the molybdenum (Mo) which is the upper material, is sandwiched by the lower material and the molybdenum which has been blown off from the molybdenum (Mo) disk which is the lower material, so that the same welding structure as shown in FIG. 4 is obtained.

Figure 7:
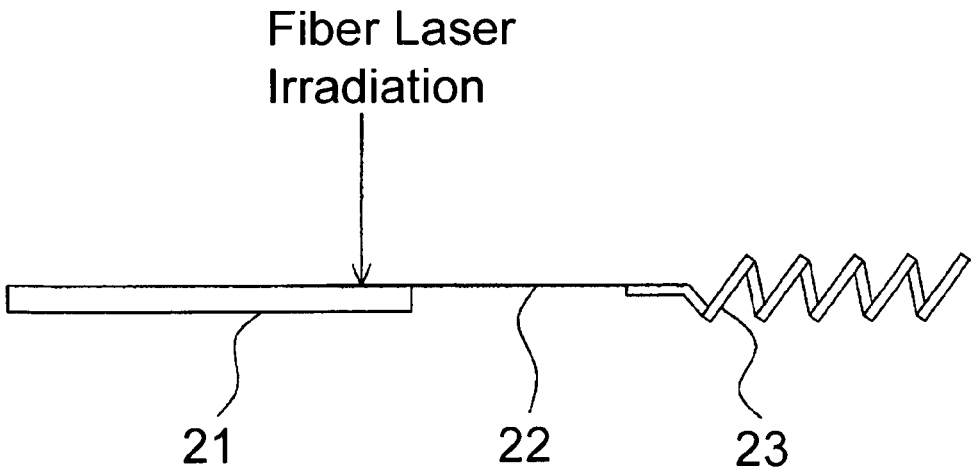
FIG. 7 is a plan view showing the entire structure of a fused joint structure when welding a sealing portion of an incandescence lamp represented by a halogen lamp.

A third embodiment according to the present invention will be given below, referring to FIG. 7. FIG. 7 is a side view of a fused joint structure when welding a sealing portion of an incandescence lamp which is represented by a halogen lamp. As shown in this figure, on an area where a metallic foil 22 connected with a filament coil 23 is placed on a surface of an external lead 21 as conductive member made of a high melting point metal, fiber laser is irradiated, thereby melting them, whereby the external lead 21 and the metallic foil 22 are joined. Also, in this embodiment, as in the fused joint structure according to the first and second embodiments, the similar welding structure as shown in FIG. 4 is acquired.

Figure 8:
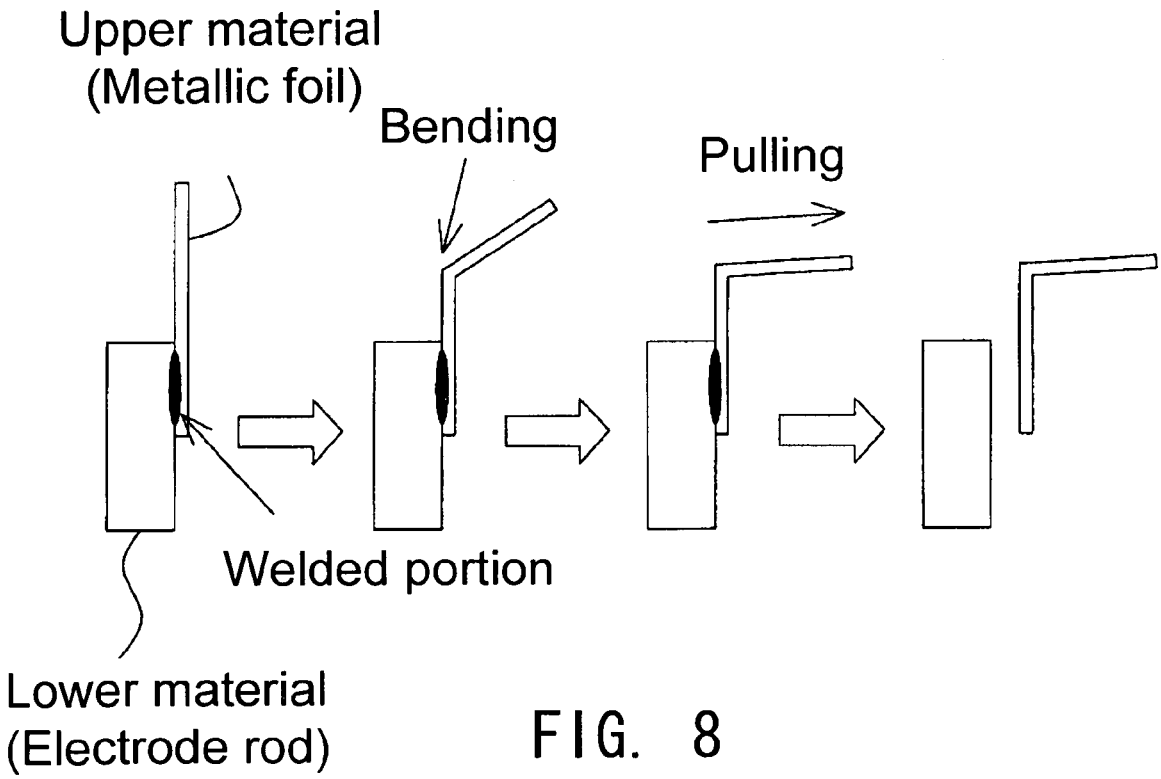
FIG. 8 is a diagram showing the experiment method for measuring welding strength.
Figure 10:
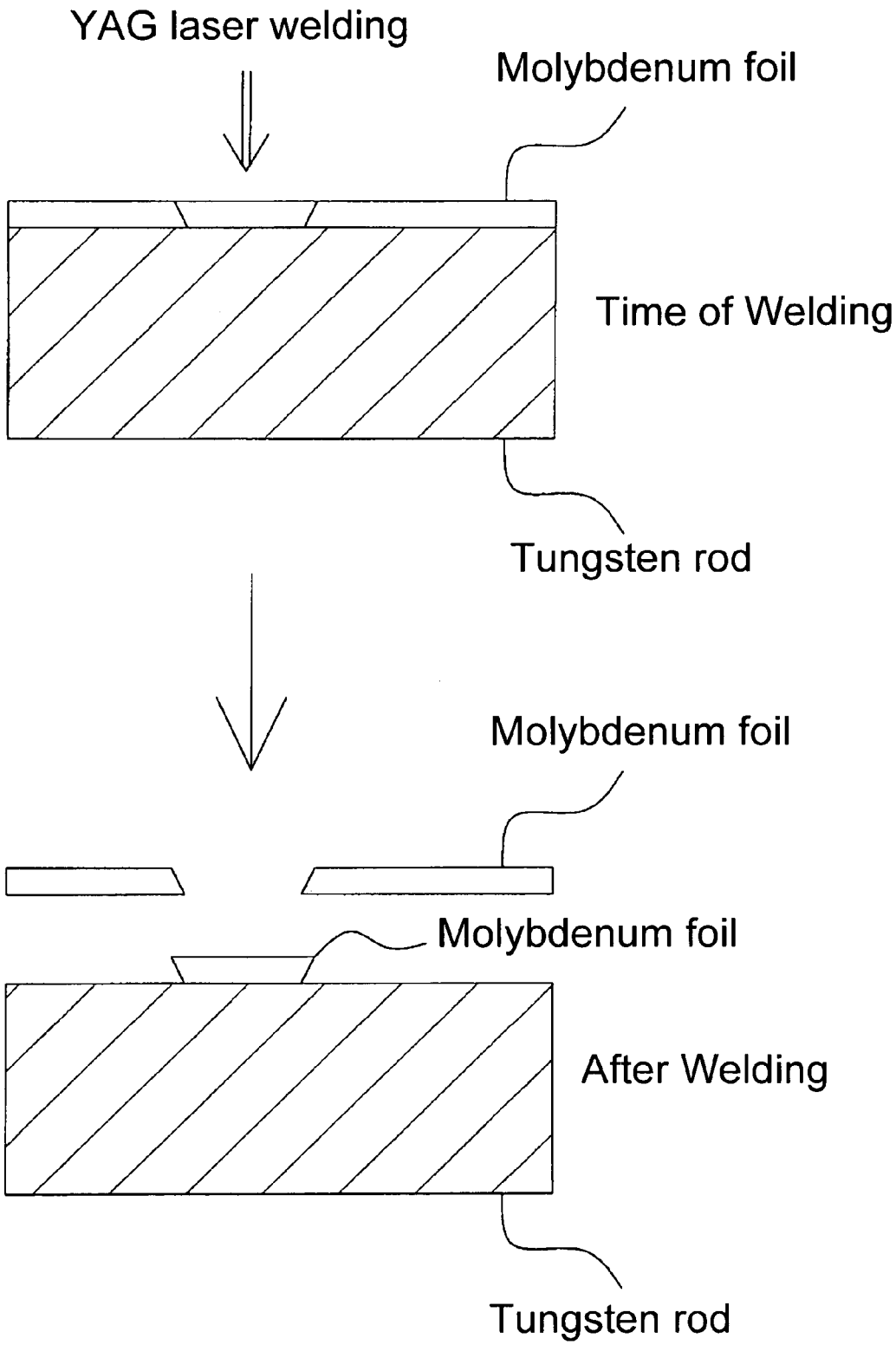
FIG. 10 is a diagram showing a case where welding peeling occurs by YAG laser welding in a fused joint structure of metallic foil and a conductive member made of a high melting point metal.

Next, ten (10) fused joint structures were prepared by conventional resistance welding, that is, welding in which YAG laser is used as described in Japanese Laid Open Patent No. 2004-363014, and also ten (10) fused joint structures were prepared by welding according to the present invention which fiber laser is used. FIGS. 9A and 9B show a result of an experiment of the welding strength based on an experiment method shown in FIG. 8. In conditions of resistance welding in the experiment method, pressurization was 2.0 kgf, voltage was 2.0V, current was 2.0 kA, and holding-time was 7 msec. In conditions of YAG laser welding, irradiation was carried out with energy density of 15 MW/cm$^2$ for 4 msec. In the conditions of fiber laser welding, the same conditions according to the first and second embodiments were applied. As shown in FIG. 8, when an electrode rod which was the lower material was fixed, a metallic foil which was the upper material after welding, was once bent, and was pulled perpendicularly to the lower material, the peel intensity was measured when the metallic foil fractured. When the average of the junction intensity by the resistance welding was made into 100%, the junction intensity of YAG laser welding and fiber laser welding were relatively compared with each other. FIGS. 9A and 9B show a measurement result of the welding strength. As can be seen from the figure, in the fused joint structure in the case of molybdenum (Mo)-tungsten (W) junction, or the molybdenum (Mo)-molybdenum (Mo) junction according to the present invention, it turned out that the variation in welding strength was very small, compared with the other fused joint structure, so that it is very stable.

The preceding description has been presented only to illustrate and describe exemplary embodiments of the present fused joint structure in a lamp tube, and the present forming method thereof according to the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A fused joint structure comprising:

a metallic foil;

a conductive member made of high melting point metal and containing an outer surface with the metal foil in contact with the outer surface; and a welded portion joining the metallic foil and the conductive member together, the welded portion, as viewed in cross-section, containing:

a bowl-shaped configuration with a concave portion extending through the metallic foil and the outer surface of the conductive member and into the conductive member: and a rim portion integrally connected to and surrounding the concave portion, the rim portion projecting outwardly from the outer surface of the conductive member and extending radially outwardly from the concave portion to overlap onto and cover a circumferential edge portion of the metallic foil.

2. The fused joint structure according to claim 1, wherein the conductive member is made of tungsten or molybdenum, and the metallic foil is made of molybdenum.

3. A method of forming the fused joint structure according to claim 1, wherein laser light whose energy is 40 MW/cm$^2$ or more, is irradiated on the area where the metallic foil is put on the outer surface of the conductive member, so as to join the conductive member and the metallic foil.

4. A method of forming the fused joint structure according to claim 2, wherein laser light whose energy is 40 MW/cm$^2$ or more, is irradiated on the area where the metallic foil is put on the outer surface of the conductive member, so as to join the conductive member and the metallic foil.

5. The fused joint structure according to claim 1, wherein the conductive member includes an internal lead rod and an external lead rod.

6. The fused joint structure according to claim 1, wherein the conductive member includes an electrode rod and an external lead rod.

7. The fused joint structure according to claim 1, wherein the conductive member includes a disk-like member connected to an electrode rod to which two or more metallic foils are welded and to an external lead.

* * * * *